United States Patent [19]

Kovacik et al.

[11] Patent Number: 4,774,647

[45] Date of Patent: Sep. 27, 1988

[54] TROUBLE LIGHT WITH CIRCUIT BREAKER

[75] Inventors: James D. Kovacik; James W. Kovacik, both of Parma; Thomas J. Blanch, Hudson; Paul S. Blanch, Valley View, all of Ohio

[73] Assignee: Alert Safety Lite Products Co., Bedford Heights, Ohio

[21] Appl. No.: 135,724

[22] Filed: Dec. 21, 1987

[51] Int. Cl.[4] ..... F21V 23/00

[52] U.S. Cl. ..... 362/295; 362/276; 362/378; 362/394; 362/41.1; 362/802

[58] Field of Search ..... 362/276, 295, 378, 411, 362/394, 802

[56] References Cited

U.S. PATENT DOCUMENTS

| | | | |
|---|---|---|---|
| 2,735,930 | 2/1956 | Weight | 362/378 |
| 3,721,889 | 3/1973 | Sondermeyer . | |
| 4,141,062 | 2/1979 | Trueblood | 362/378 |
| 4,275,435 | 6/1981 | Dorn | 362/378 |
| 4,434,454 | 2/1984 | Day | 362/295 |
| 4,667,131 | 5/1987 | Nilssen . | |

OTHER PUBLICATIONS

Alert Stamping and Manufacturing Co., Inc. Catalog.

*Primary Examiner*—Douglas Hart
*Attorney, Agent, or Firm*—Marshall & Melhorn

[57] ABSTRACT

A trouble light incorporates a circuit breaker in its handle to reduce the possibility of shock to a user. The handle is formed of right and left shells and includes a screw-type receptacle for a lamp and an electrical plug receptacle. The circuit breaker is connected in a series with a power cord, and to the screw-type receptacle and the electrical plug receptacle. The circuit breaker instantly interrupts power to the receptacles upon detection of excess current flow in the circuit in the trouble light. The handle shells are molded from an insulating material such as plastic and internal webs are formed to retain the various electrical circuit elements in the handle.

18 Claims, 2 Drawing Sheets

TROUBLE LIGHT WITH CIRCUIT BREAKER

BACKGROUND OF THE INVENTION

The present invention relates to a trouble light with a circuit breaker, and more patiularly to a trouble light handle with a circuit breaker contained therein.

The use of electrical trouble lights in industry is widely known. The trouble lights are used in situations where additional illumination is required due to the impairment of other sources of light. The trouble lights frequently encounter severe service when used in these situations, as they are normally employed by businesses servicing mechanical equipment in tight quarters and are frequently damaged in use. Typically these businesses are service oriented, and include petroleum and service station operators, where additional illumination is required under an automobile, for example.

The severe service situations in which the trouble light is frequently used and damaged creates an additional hazard of electrical shock. The trouble lights are frequently damaged due to impacts, shattered light bulbs and from crushing. Normally, the only protection offered the user of the trouble light in these situations is afforded by the circuit breaker panel or fuse panel of the circuit into which the trouble light is connected.

U.S. Pat. No. 3,721,889 discloses a circuit with means for sensing the absence of a load in the circuit. The circuit includes an inverter adapted to provide power to the load as necessary. When the sensing means detects an absence of a load in the circuit, it inhibits the operation of the inverter thereby providing protection from electrical overload or shock.

U.S. Pat. No. 4,667,131 discloses a protection circuit for fluorescent lamp ballasts. The circuit involves means for sensing the proper connection to the ballast of the fluorescent lamps by detecting the proper flow of lamp cathode heating currents. The circuit includes a series-resonant loaded inverter-type electronic ballast for two rapid-start fluorescent lamps. If less than normal current is drawn or the lamps do not start within about one second, the inverter circuit is shut down. Thus, the sensing means meets the requirements for safety from electric shock hazard, as well as protects the inverter circuit from overload.

It is the object of the present invention to provide a trouble light for severe service usage which will protect the user from electric shock hazard.

SUMMARY OF THE INVENTION

The present invention relates to a trouble light with a circuit breaker, and more particularly to a trouble light handle with a circuit breaker contained therein.

In accordance with the present invention, two cooperating half shells attached to one another by fasteners form a trouble light handle. An electrical screw-type socket is positioned at one end of the handle and an aperture for receiving an electrical cord is formed at the opposite end. The trouble light handle is further configured with a circuit breaker disposed within the handle between the cooperating shells.

The electrical screw-type socket is connected to a push button on-off switch and receives a conventional incandescent light bulb. The switch extends through an aperture disposed in each half shell of the trouble light handle and provides an on and off control for electrical current to the socket.

The trouble light is also configured with a conventional ground receptacle in one of the half shells of the trouble light handle. The ground receptacle provides a convenient means for accepting a conventional electric plug for attaching an electrical device, such as an electric drill, for example. This provides the user of the trouble light with an easily accessible electric outlet at the area where the additional illumination is needed.

The trouble light is further constructed with a circuit breaker located within the handle between the half shells. The circuit breaker is connected to both the socket and the ground receptacle and provides a safety device against electrical shock hazard in the handle of the trouble light. The circuit breaker interrupts the electrical circuit in the event of a high current flow condition. The circuit breaker is resettable after a cooling down period following circuit interruption. A reset button provided in the circuit breaker extends through the handle of the trouble light so as to provide a means whereby the user of the trouble light can reactuate the electrical circuit following the interruption of electrical current by the circuit breaker.

BRIEF DESCRIPTION OF THE DRAWINGS

The above objects and advantages of the invention will become manifest to one skilled in the art from considering the following detailed description of an embodiment of the invention in light of the accompanying drawings, in which.

DESCRIPTION OF THE PREFERRED EMBODIMENT

Figure 1:
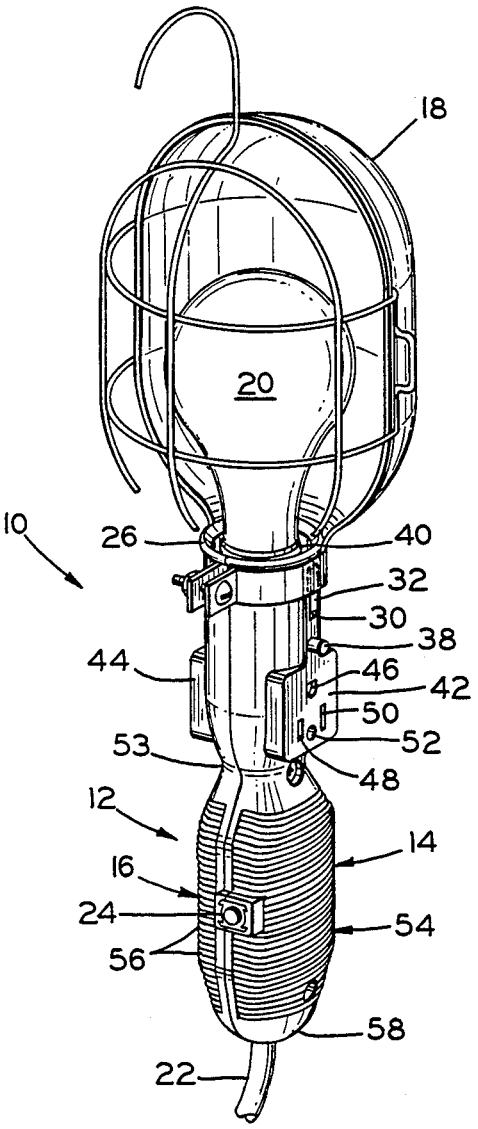
FIG. 1 is a perspective view of a trouble light in accordance with the present invention.

Turning now to the drawings, there is illustrated in FIG. 1 a trouble light 10, including a tubular handle 12 comprised of a right half shell 14 and a left half shell 16, a lamp guard 18, a lamp 20, an electric cord 22 and a circuit breaker 24.

The handle 12 of the trouble light 10 is constructed of a electrical insulator material such as plastic, for example, and configured at one end with a lip 26 surrounding an opening and a smaller diameter neck 28 disposed below the lip 26 around which the lamp guard 18 is attached. A slot 30 is formed in the right shell 14 of the handle 12 below the neck 28. The slot 30 provides a means through which a ground strap 32 can extend outwardly and upwardly from the inside of the handle 12, thereby providing an electrical grounding means for the lamp guard 18. A pair of opposed apertures 34 and 36 are formed in the shells 14 and 16, respectively, of the handle 12 through which extends a push button type switch 38 of a standard screw-type receptacle 40 adapted to receive the standard incandescent light bulb or lamp 20. The switch 38 provides an on and off means for controlling current to the receptacle 40.

The handle 12 is further configured with two diametrically opposed bosses 42 and 44 positioned below the apertures 34 and 36 respectively. The boss 42 is formed on the right shell 14 of the handle 12 and includes four apertures 46, 48, 50 and 52. The apertures 46, 48 and 50, formed in the right shell 14, provide access to a standard ground receptacle disposed within the handle 12 into which a standard electrical plug can be inserted. The aperture 52 provides an opening through which a fastener can be inserted in order to affix the ground receptacle to the right shell 14 of the handle 12.

Figure 6:
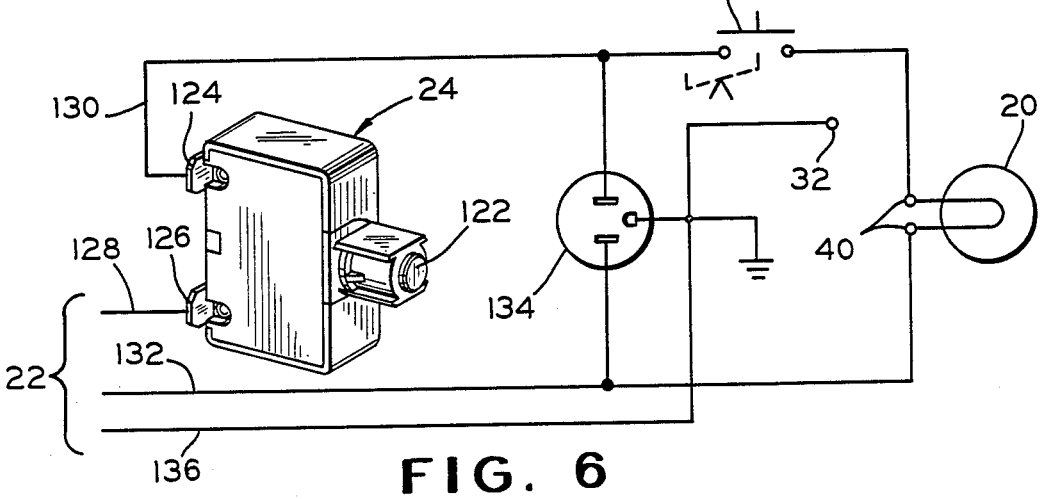
FIG. 6 is an electrical circuit schematic and a perspective view of the circuit breaker used in conjunction with the trouble light illustrated in FIG. 1.

The handle 12 is tapered inwardly at 53 midway between its opposite ends and below the bosses 42 and 44. The handle 12 increases in diameter below the taper 53 forming a hand grip portion 54 having generally vertical sides. The hand grip portion 54 is normally used for grasping by a human hand. In order to provide a non-slip gripping surface, the grip portion 54 is constructed with a plurality of ribs 56, which extend substantially around the grip portion 54 of the handle 12. The grip portion 54 then decreases in diameter terminating in a hemispherical closed end 58. The hemispherical end 58 has an aperture 60 formed therein through which the cord 22 passes into the handle 12. The cord 22 connects to the circuit breaker 24 which in turn is connected to the ground receptacle and screw-type receptacle 40 in standard fashion as shown in FIG. 6, thereby forming an electrical circuit.

Figure 2:
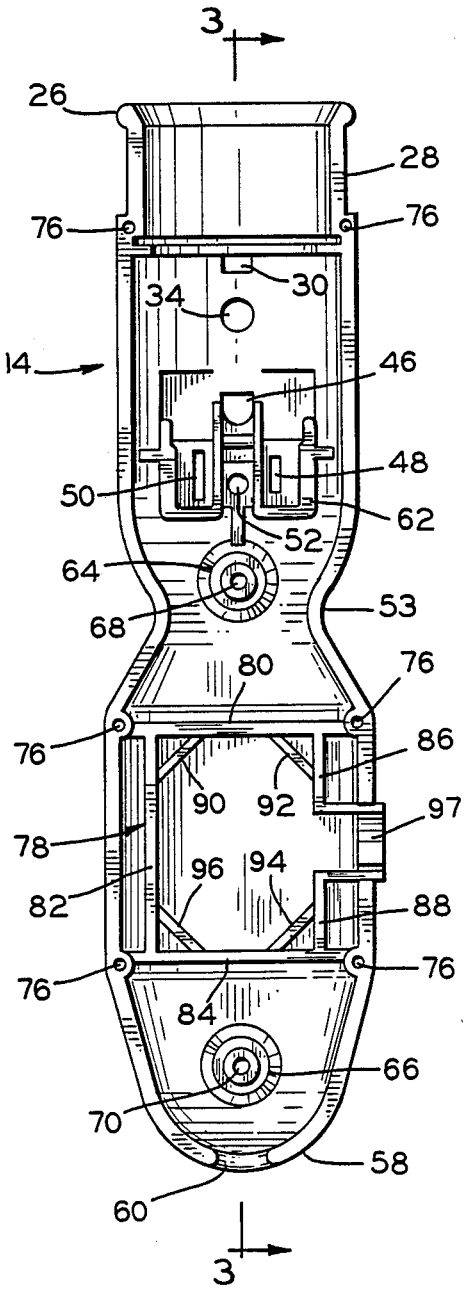
FIG. 2 is rear elevation view of the right shell of the trouble light handle illustrated in FIG. 1.
Figure 3:
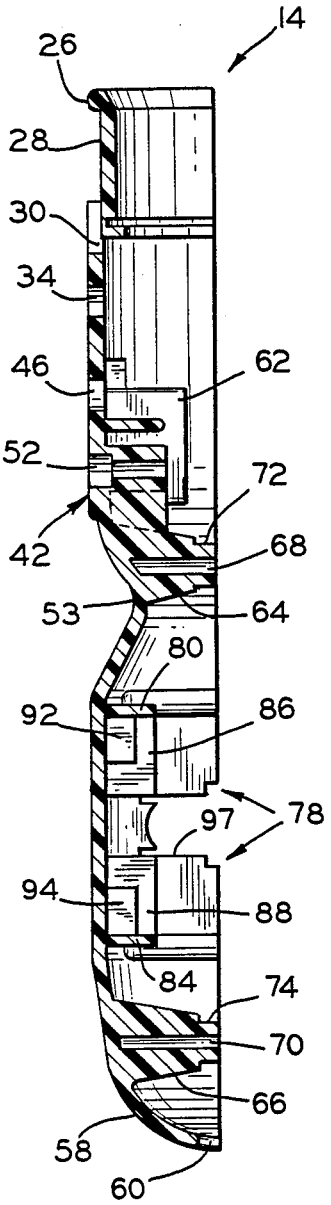
FIG. 3 is a sectional view of the right shell taken along line 3—3 in FIG. 2.

The inner side of the right shell 14 of the handle 12, as illustrated in FIG. 2, is formed with a web 62 configured around the apertures 46, 48 and 50 onto which the ground receptacle is seated. The web 62 additionally provides a support structure which facilitates in maintaining the ground receptacle securely in position once affixed to the shell 14. The right shell 14 is further provided with bosses 64 and 66 in which blind holes 68 and 70, respectively, are formed. The bosses 64 and 66 are each tapered toward a stepped end 72 and 74, respectively, and are used for locating in receiving cavities formed in the left shell 16. The peripheral edge of the right shell 14 is also formed with a plurality of blind apertures 76 which provide locating reliefs for a plurality of locating pins formed in corresponding positions along the peripheral edge of the left shell 16.

The right shell 14 is also formed with a web 78 constructed within the hand grip portion 54. As illustrated in FIG. 2, the web is defined by walls 80, 82 and 84 which from three sides of a box and wall portions 86 and 88, the corners of which are reinforced by gussets 90, 92, 94 and 96. The web 78 locates the circuit breaker 24 between the left shell 16 and the right shell 14 within the trouble light handle 12. The wall portions 86 and 88 of the web 78 are formed so as to create an opening therebetween, which opening extends outwardly from the handle 12 and permits the projection of the circuit breaker 26 through the trouble light handle 12.

Figure 4:
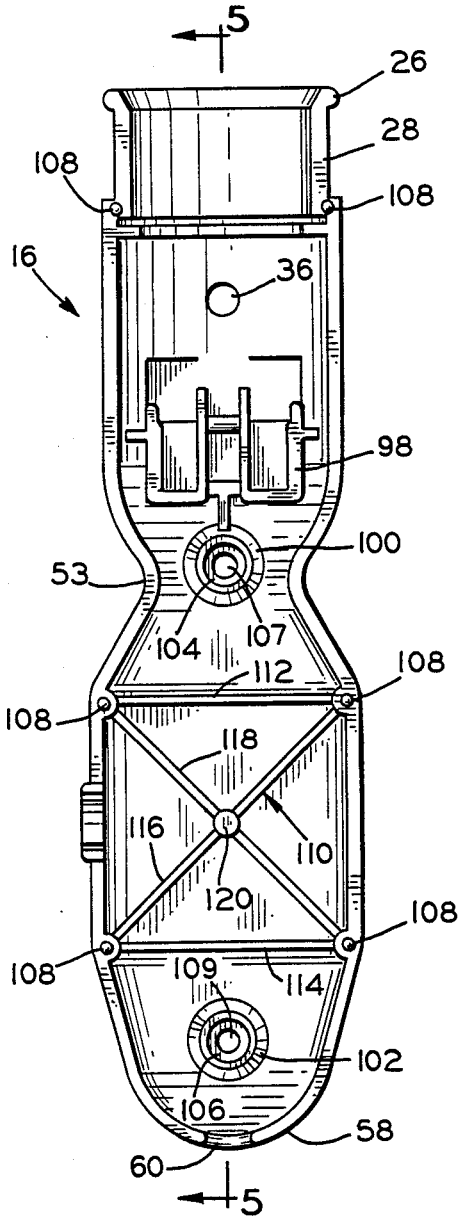
FIG. 4 is a rear elevation view of the left shell of the trouble light handle illustrated in FIG. 1.
Figure 5:
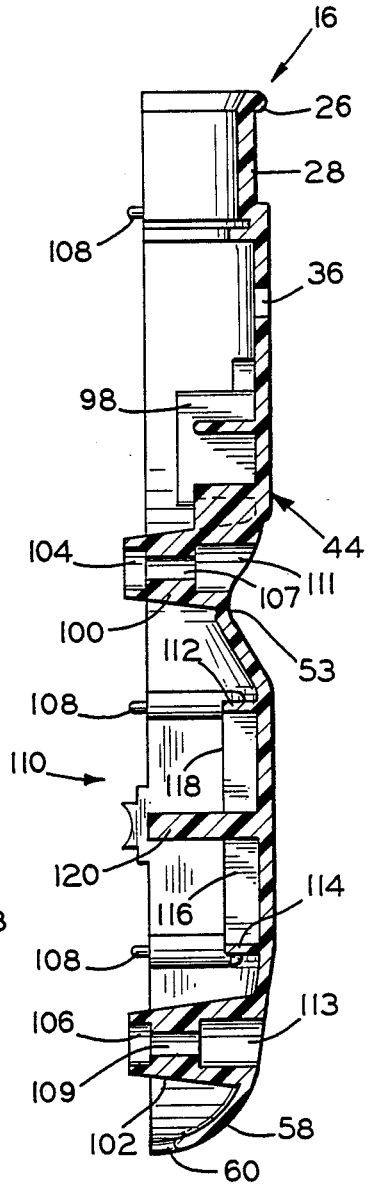
FIG. 5 is a sectional view of the left shell taken along line 5—5 in FIG. 4.

As illustrated in FIG. 4, the left shell 16 is constructed to form a cooperating side with the right shell 14 of the trouble light handle 12. The left shell 16 is formed with a web 98 which cooperates in positioning and securing the ground receptacle along with web 62 of the right shell 14. The left shell 16 is also formed with a pair of internal bosses 100 and 102, respectively. As illustrated in FIG. 5, the bosses taper to ends which are configured with cavities 104 and 106. The stepped ends 72 and 74, of the bosses 64 and 66 respectively, of the right shell 14 extend into the cavities 104 and 106, respectively, thereby positioning shells 14 and 16 in a cooperating face to face location. The bosses 100 and 102 are also configured with apertures 107 and 109 respectively, formed therethrough. The apertures 107 and 109 provide means through which threaded fasteners can be inserted in order to affix the right shell 14 to the left shell 16. As illustrated in FIG. 5, the apertures 107 and 109 connect cavities 111 and 113 on the outer side of the shell 16 with the cavities 104 and 106 respectively. The cavities 111 and 113 allow the head of the threaded fasteners to extend into and below the outer surface of the shell 16.

The left shell 16 is further includes a plurality of locating pins 108 formed along the peripheral edge. The locating pins 108 are disposed along the peripheral edge of the left shell 16 in positions corresponding to the blind apertures 76 formed in the peripheral edge of the right shell 14. The locating pins 108 of the left shell 16 extend into the apertures 76 of the right shell 14 thereby cooperating so as to align the shells 14 and 16 to fashion the handle 12. The left shell 16 is also formed with a web 110 located in the grip portion of the shell. The web 110 is located in a position opposite the position of the web 78 located in the grip portion of the right shell 14. The web 110 is formed by walls 112 and 114 which extend horizontally across the shell 16 and are diagonally reinforced by walls 116 and 118. The diagonal walls 116 and 118 form a cross configuration and a post 120 extends outwardly at an intersection point. The post 120 applies pressure to the side of the circuit breaker 24 when installed within the handle 12 of the trouble light 10, thereby firmly seating the circuit breaker into the web 78 of the right shell 14.

Illustrated in FIG. 6, is the circuit breaker 24 used in accordance with the present invention. The circuit breaker 24 is placed between the shells 14 and 16 during the construction of the trouble light 10. The circuit breaker 24 is configured with a button 122 which can be used to reset the circuit breaker 24 following the interruption of power. The circuit breaker 24 is also constructed with electrical terminals 124 and 126. One line 128 of the cord 22 is connected to the terminal 126 and the other terminal 124 is connected to a line 130 to place the circuit breaker 24 in series with the cord 22. The terminals 124 and 126 are shown as the spade-type connection variety, but may be of the screw attachment type or any other suitable terminal.

Another line 132 and the line 130 are connected to opposite sides of a ground receptacle 134. The push button switch 38 and the screw-type receptacle 40 are connected in series between the lines 130 and 132 to complete the circuit for the trouble light 10.

In use, the trouble light user applies electric current to the lamp 20 by pushing the switch 38 into the on position. This illuminates the lamp 20, thereby providing additional light to the user. The electrical current is interrupted to the trouble light 10 in the event of damage, or a short in the handle 12. This interruption is achieved by the disconnection of electrical current through the circuit breaker 24 to the screw-type receptacle 40 and the ground receptacle 134. The circuit breaker 24 typically contains an electric current carrying bi-metal strip configured within and connected to the electric circuit. The bi-metal strip upon detecting increased current flow in the trouble light 10 expands in a curved fashion due to increased heat energy caused by the current. The expansion of the bi-metal strip causes the same to migrate away from the electrical connection thereby breaking the electric circuit and interrupting current flow. After the bi-metal strip has cooled sufficiently, the electric circuit can be reinstated through resetting the circuit breaker 24 by pushing in on the button 122. In accordance with the present invention, the use of the circuit breaker 24 in the handle 12 of the trouble light 10 prevents electric shock hazard to the user of same by instantly interrupting the electric current supplied.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a trouble light having a handle and a receptacle for a lamp retained in the handle, the handle comprising:

a pair of complementary half shells cooperating to form a tubular handle having a larger opening formed at one end for retaining a lamp receptacle and a smaller opening formed at an opposite end adapted to receive a multi-conductor electrical cord;

a first one of said half shells having a plurality of blind apertures formed about a periphery thereof, a first web adapted to position an electrical receptacle in said larger opening, and a second web adapted to position a circuit breaker in said handle; and a second one of said half shells having a plurality of locating pins formed about a periphery thereof cooperating with said blind apertures to position said first half shell with respect to said second half shell, a third web adapted to cooperate with said first web to retain said electrical receptacle, and a fourth web adapted to cooperate with said second web to retain said circuit breaker in said handle.

2. A trouble light handle according to claim 1 wherein said first and second half shells each have a lip formed about said larger opening and a smaller diameter neck disposed below said lip.

3. A trouble light handle according to claim 2 including a lamp guard attached to said handle about said neck.

4. A trouble light handle according to claim 3 including a slot formed in said second half shell adjacent said neck and a ground strap extending through said slot and electrically connected to said lamp guard.

5. A trouble light handle according to claim 1 wherein each of said half shells has an aperture formed therein for receiving opposite ends of a push button switch.

6. A trouble light handle according to claim 1 wherein said first half shell has a plurality of apertures formed adjacent said first web for providing access for prongs of an elecrical plug.

7. A trouble light handle according to claim 1 wherein said first and second half shells each have a pair of bosses formed therein, said bosses of said first half shell tapering to a stepped end and said bosses of said second half shell tapering to an aperture, said stepped ends and said apertures cooperating to position said first half shell with respect to said second half shell.

8. A trouble light handle according to claim 1 wherein said second web is formed as a generally rectangular box having four walls, one of said walls having an opening formed therein for receiving a circuit breaker reset button.

9. A trouble light handle according to claim 8 including a gusset formed at a junction of each pair of adjacent ones of said walls.

10. A trouble light handle according to claim 8 wherein said fourth web is formed of a pair of generally parallel walls having ends connected by a pair of diagonal walls.

11. A trouble light handle according to claim 10 including a post extending from an intersection of said diagonal walls to a position adjacent said second web.

12. A trouble light handle according to claim 1 including a pair of bosses formed in each of said first and second half shells, said bosses formed in said first half shell each having a blind aperture formed in an end facing said second half shell, and said bosses formed in said second half shell each having a recessed aperture formed therethrough for receiving a threaded fastener to releasably secure said first and second half shells together.

13. A trouble light comprising:

a handle formed of left and right half shells and including a larger aperture formed at one end and a smaller aperture formed in an opposite end;

a screw-type lamp receptacle located in said larger aperture;

an electrical plug receptacle located inside said handle;

a circuit breaker located inside said handle;

a push button on-off switch located inside said handle;

a multi-conductor electrical cord extending through said smaller diameter aperture and electrically connected to said lamp receptacle, said plug receptacle, said switch, and said circuit breaker:

a plurality of ribs formed on an exterior of said left and right half shells adjacent said smaller aperture;

a first pair of webs, one said web formed inside each of said left and right shells for retaining said plug receptacle;

a pair of switch apertures, one formed in each of said half shells for receiving opposite ends of said push button switch;

a second pair of webs, one said web formed inside each of said shells for retaining said circuit breaker; and means for attaching said shells together.

14. A trouble light according to claim 13 including a lamp guard attached to said shells adjacent said lamp receptacle and wherein one of said shells has a slot formed therein for receiving a ground strap electrically connected between said lamp guard and said cord.

15. A trouble light according to claim 13 wherein said left shell has a plurality of blind apertures formed along a periphery thereof and said right shell has a plurality of cooperating pins formed along a periphery thereof.

16. A trouble light according to claim 13 including a pair of bosses formed inside each of said shells, said bosses in said right shell having apertures formed therethrough and wherein said fasteners extend through said boss apertures into threaded engagement with said left shell bosses.

17. A trouble light comprising:

a tubular handle formed of a pair of complementary half shells having a larger opening at one end and a smaller opening at an opposite end;

a lamp receptacle located in said larger opening;

an on-off switch located inside said handle;

a circuit breaker located inside said handle, said circuit breaker having a reset button extending through an aperture formed in one of said half shells; and a multi-conductor cord extending through said smaller aperture, two conductors of said cord electrically connected in series with said lamp receptacle, said switch, and said circuit breaker.

18. A trouble light comprising:

a tubular handle formed of an electrical insulating material and having a generally circular cross-section, said handle having a larger opening formed at one end and a smaller opening formed at an opposite end, said handle being divided along its longitudinal axis to form first and second half shells;

a screw-type receptacle positioned in said larger opening and adapted to retain a lamp;

a circuit breaker positioned inside said handle, each of said first and second half shells having a web formed therein for abutting and retaining said circuit breaker;

a push button on-off switch positioned inside said handle and having a push button actuator extending through an aperture formed in each of said first and second half-shells;

a multi-conductor electrical cord extending through said smaller aperture into said handle, said circuit breaker, said switch and said receptacle being connected in series between two lines of said cord;

a lamp guard attached to said handle adjacent said larger opening; and a ground strap extending through a slot formed in one of said half shells and electrically connected between said lamp guard and a third line of said cord.

* * * * *